US009418592B2

(12) United States Patent
Min et al.

(10) Patent No.: US 9,418,592 B2
(45) Date of Patent: Aug. 16, 2016

(54) ORGANIC LIGHT EMITTING DISPLAY DEVICE HAVING A POWER SUPPLIER FOR OUTPUTTING A VARIED REFERENCE VOLTAGE

(71) Applicant: LG DISPLAY CO., LTD., Seoul (KR)

(72) Inventors: Kyoung Won Min, Seoul (KR); Gi Hong Kim, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 125 days.

(21) Appl. No.: 14/075,260

(22) Filed: Nov. 8, 2013

(65) Prior Publication Data

US 2014/0132589 A1 May 15, 2014

(30) Foreign Application Priority Data

Nov. 9, 2012 (KR) ..... 10-2012-0126992

(51) Int. Cl.
*G09G 3/32* (2016.01)

(52) U.S. Cl.
CPC ..... *G09G 3/3233* (2013.01); *G09G 2300/043* (2013.01); *G09G 2300/0426* (2013.01); *G09G 2310/08* (2013.01); *G09G 2320/0223* (2013.01); *G09G 2320/0233* (2013.01); *G09G 2330/02* (2013.01)

(58) Field of Classification Search
USPC ..... 345/83
See application file for complete search history.

(56) References Cited

U.S. PATENT DOCUMENTS

| | | | | |
|---|---|---|---|---|
| 2004/0251846 | A1* | 12/2004 | Choi | G09G 3/3233 315/169.3 |
| 2005/0067968 | A1* | 3/2005 | Yamashita | 315/167 |
| 2006/0022305 | A1* | 2/2006 | Yamashita | G09G 3/2014 257/565 |
| 2006/0028408 | A1 | 2/2006 | Kim | |
| 2006/0082527 | A1* | 4/2006 | Ogawa | 345/82 |
| 2009/0167649 | A1* | 7/2009 | Ishizuka | G09G 3/3258 345/80 |
| 2009/0219308 | A1 | 9/2009 | Sagano | |
| 2011/0128268 | A1 | 6/2011 | Kim et al. | |

FOREIGN PATENT DOCUMENTS

| | | | |
|---|---|---|---|
| CN | 1716370 | A | 1/2006 |
| CN | 102081903 | A | 6/2011 |
| CN | 102110401 | A | 6/2011 |
| JP | 2009-210600 | | 9/2009 |
| KR | 1020080010873 | A | 1/2008 |
| KR | 10-2008-0075386 | A | 8/2008 |
| KR | 1020100104551 | A | 9/2010 |
| KR | 1020110083121 | A | 7/2011 |

(Continued)

OTHER PUBLICATIONS

Office Action issued in Korean Patent Application No. 10-2012-0126992, mailed Apr. 30, 2014, 6 pages.

(Continued)

*Primary Examiner* — Long D Pham
(74) *Attorney, Agent, or Firm* — Brinks Gilson & Lione

(57) ABSTRACT

An organic light emitting display device includes: an organic light emitting display panel configured to include a plurality of power lines, a plurality of scan lines and a plurality of data lines; a power supplier configured to apply a reference voltage to the power lines; and a controller configured to apply at least one control signal to the power supplier. The reference voltage is gradually varied along the distance from the power supplier.

15 Claims, 9 Drawing Sheets

(56) References Cited

FOREIGN PATENT DOCUMENTS

| | | | |
|---|---|---|---|
| TW | 200841292 | A | 10/2008 |
| TW | 201120850 | A | 6/2011 |
| TW | I375196 | B | 10/2012 |

OTHER PUBLICATIONS

Office Action dated Aug. 24, 2015 for corresponding Taiwanese Patent Application No. 10421129340, 6 pages.

Office Action dated May 29, 2015 for corresponding Chinese Patent Application No. 201310537611.5, 6 pages.

* cited by examiner

ORGANIC LIGHT EMITTING DISPLAY DEVICE HAVING A POWER SUPPLIER FOR OUTPUTTING A VARIED REFERENCE VOLTAGE

The present application claims priority under 35 U.S.C. §119(a) of Korean Patent Application No. 10-2012-0126992 filed on Nov. 9, 2012, which is hereby incorporated by reference in its entirety.

BACKGROUND

1. Field of the Disclosure

The present application relates to an organic light emitting display device.

2. Description of the Related Art

Display devices for displaying information are being widely developed. The display devices include liquid crystal display devices, organic light-emitting display devices, electrophoresis display devices, field emission display devices, and plasma display devices.

Among these display devices, organic light-emitting display devices have the features of lower power consumption, wider viewing angle, lighter weight and higher brightness compared to the liquid crystal display devices. As such, the organic light-emitting display device is considered to be next generation display devices.

FIG. 1 is a circuit diagram showing a pixel region of an organic light emitting display device according to the related art.

As shown in FIG. 1, a data line DL and a power supply line PL parallel to each other are formed in a pixel region of the organic light emitting display device according to the related art. Also, a gate line GL is formed in the pixel region in such a manner as to cross the data line DL and the power supply line PL. Moreover, first through third transistors T1 through T3, a capacitor C and an organic light emission element OLED can be formed in the pixel region.

The third transistor T3 is connected to the power supply line PL and controls the power supply voltage Vdd to be supplied to the organic light emission element OLED. The first transistor T1 selectively supplies a data voltage on the data line DL to a gate electrode of the third transistor T3 (i.e., a first node N1) in synchronization with a gate signal, which is applied from the gate line GL. The second transistor T2 selectively supplies a reference voltage Vref to a second node N2 in synchronization with the gate signal on the gate line GL. The third transistor T3 controls a current being applied to the organic light emission element OLED according to a different voltage between the data voltage and the reference voltage Vref, thereby displaying an image.

The recent trend towards larger size of the organic light emitting display device forces the power supply line PL, which transfers the power supply voltage Vdd to the organic light emission element OLED, to be lengthened. As such, the power supply voltage Vdd being applied from one end of the organic light emitting display device must be dropped by the resistance of the power supply line. Due to this, variation of brightness must be generated between one edge of the organic light emitting display device, which inputs the power supply voltage, and the other end. Therefore, picture quality can deteriorate.

SUMMARY

An organic light emitting display device includes: an organic light emitting display panel configured to include a plurality of power lines, a plurality of scan lines and a plurality of data lines; a power supplier configured to apply a reference voltage to the power lines; and a controller configured to apply at least one control signal to the power supplier. The reference voltage is gradually varied along the distance from the power supplier.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE EMBODIMENTS

Figure 1:
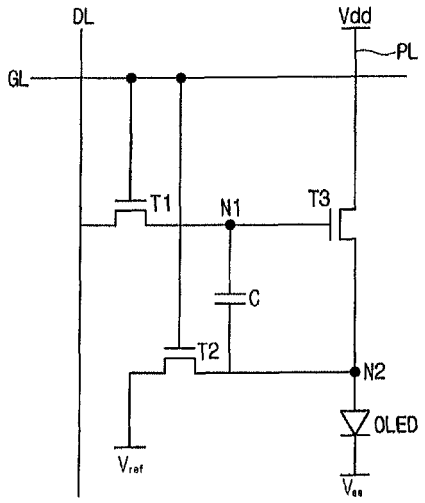
FIG.1 (Related Art)
FIG. 1 is a circuit diagram showing a pixel region of an organic light emitting display device according to the related art.

In the present disclosure, it will be understood that when an element, such as a substrate, a layer, a region, a film, or an electrode, is referred to as being formed "on" or "under" another element in the embodiments, it may be directly on or under the other element, or intervening elements (indirectly) may be present. The term "on" or "under" of an element will be determined based on the drawings. Reference will now be made in detail to the present embodiments, examples of which are illustrated in the accompanying drawings. In the drawings, the sizes and thicknesses of elements can be exaggerated, omitted or simplified for clarity and convenience of explanation, but they do not mean the practical sizes of elements.

An organic light emitting display device according to an embodiment of the present disclosure can include: an organic light emitting display panel configured to include a plurality of power lines, a plurality of scan lines and a plurality of data lines; a power supplier configured to apply a reference voltage to the power lines; and a controller configured to apply at least one control signal to the power supplier. The reference voltage is gradually varied along the distance from the power supplier.

The power supplier can include: a reference voltage generator configured to generate a basic voltage corresponding to a direct-current voltage; an integrator configured to integrate the basic voltage and generate the reference voltage; and a switch configured to selectively transfer the basic voltage to the integrator.

The switch can be controlled by a vertical synchronous signal applied from the controller.

The switch can be turned-off in a low level interval of the vertical synchronous signal.

The organic light emitting display device can further include a switch controller configured to control the switch.

The switch controller can be controlled by a data enable signal applied from the controller.

The switch controller can include a counter configured to count the number of pulses of the data enable signal.

The switch can be turned-off at a first rising edge of the data enable signal.

The power supplier can include a DAC (digital-to-analog converter) configured to convert a reference data from the controller into a basic voltage. The reference data is a digital signal, and the basic voltage is an analog voltage.

The power supplier can further include a buffer configured to amplify the basic voltage from the DAC and provide the amplified voltage as the reference voltage.

The power supplier can include an integrator configured to integrate a pulse voltage from the controller according to time and generate the reference voltage.

The pulse voltage can be output from the controller in synchronization with the data enable signal.

Figure 2:
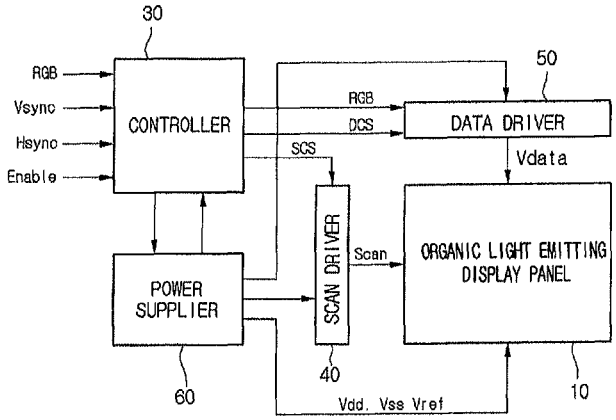
FIG. 2 is a block diagram showing an organic light emitting display device according to an embodiment of the present disclosure.

FIG. 2 is a block diagram showing an organic light emitting display device according to an embodiment of the present disclosure.

Referring to FIG. 2, the organic light emitting display device according to an embodiment of the present disclosure includes an organic light emitting display panel 10, a controller 30, a scan driver 40, a data driver 50 and a power supplier 60.

The controller 30 receives video data RGB, a horizontal synchronous signal Hsync, a vertical synchronous signal Vsync and an enable signal Enable from the exterior. Also, the controller 30 generates scan control signals SCS, data control signals DCS and a data enable signal DE using the horizontal synchronous signal Hsync, the vertical synchronous signal Vsync and the enable signal Enable. The scan control signals GCS are used to drive the scan driver 40. Also, the scan control signal GCS are applied from the controller 30 to the scan driver 40. The data control signals DCS are used to driver the data driver 50. Also, the data control signal DCS together with the video data RGB are applied from the controller 30 to the data driver 50. The data enable signal DE is used to define an output interval of the data. Also, the data enable signal DE is applied from the controller 30 to the power supplier 60.

The scan control signal SCS includes a gate start pulse GSP, a gate shift clock GSC and a gate output enable signal GOE. The data control signal DCS includes a source shift clock SSC, a source start pulse SSP, a polarity control signal POL and a source output enable signal SOE.

The scan driver 40 generates scan signals Scan using the scan control signals SCS. The scan signals Scan can be applied from the scan driver 40 to the organic light emitting display panel 10.

The data driver 50 generates data voltages Vdata using the video data RGB and the data control signals DCS. The data voltages Vdata are applied from the data driver 50 to the organic light emitting display panel 10.

The power supplier 60 generates supply voltages necessary to drive the controller 30, the scan driver 40 and the data driver 50. More specifically, the power supplier 60 divides an external voltage into a plurality of divided voltages and applies the divided voltages to the controller 30, the scan driver 40 and the data driver 50. Also, the power supplier 60 applies a first supply voltage Vdd, a second supply voltage Vss and a reference voltage Vref to the organic light emitting display panel 10. The first and second supply voltages Vdd and Vss can be direct-current voltages. The reference voltage Vref can be a periodically varied voltage.

Moreover, the power supplier 60 can receive one of the vertical synchronous signal Vsync and the data enable signal DE. The power supplier 60 can enable the reference voltage Vref to be periodically varied in synchronization with one of the vertical synchronous signal Vsync and the data enable signal DE.

Figure 3:
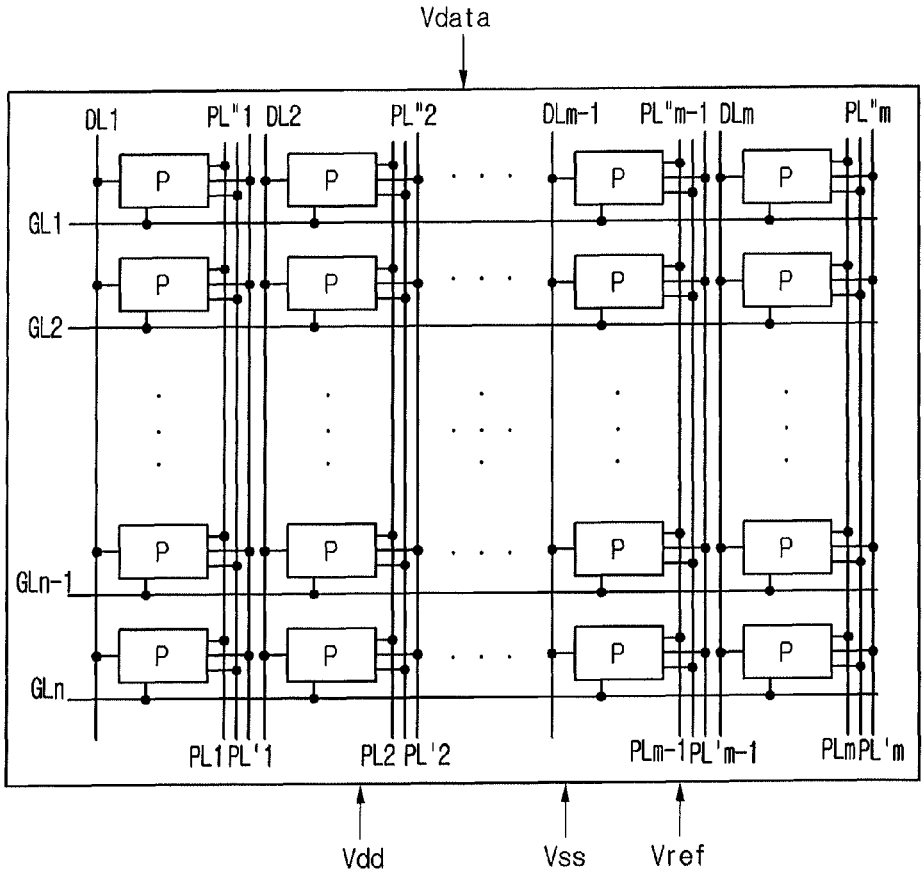
FIG. 3 is a circuit diagram showing the organic light emitting display panel in FIG. 2.

FIG. 3 is a circuit diagram showing the organic light emitting display panel according to a first embodiment of the present disclosure.

Referring to FIG. 3, the organic light emitting display panel 10 can include a plurality gate lines GL1~GLn, a plurality of data lines DL1~DLm, a plurality of primary power lines PL1~PLm, a plurality of secondary power lines PL'1~PL'm and a plurality of tertiary power lines PL"1~PL"m.

Although it is not shown in the drawing, the organic light emitting display panel 10 can further include a plurality of signal lines as needed.

A plurality of pixel regions P can be defined by the gate lines GL1~GLn and the data lines DL1~DLm crossing each other. Each of the pixel regions P can be electrically connected to one of the gate lines GL1~GLn, one of the data lines DL1~DLm, one of the primary power lines PL1~PLm, one of the secondary power lines PL'1~PL'm and one of the tertiary power lines PL"1~PL"m.

For example, each of the gate lines GL1~GLn can be electrically connected to the plurality of pixel regions P which are arranged in a horizontal direction. Each of the data lines DL1~DLm can be electrically connected to the plurality of pixel regions P which are arranged in a vertical direction.

The scan signal Scan, the data voltage Vdata, the first supply voltage Vdd, the second supply voltage Vss and the reference voltage Vref can be applied to the pixel region P.

More specifically, the scan signal Scan can be applied to the pixel region P through one of the gate lines GL1~GLn. The data voltage Vdata can be applied to the pixel region P through one of the data lines DL1~DLm. The first supply voltage Vdd can be applied to the pixel region P through one of the primary power line PL1~PLm. The second supply voltage Vss can be applied to the pixel region P through one of the secondary power line PL'1~PL'm. The reference voltage Vref can be applied to the pixel region P through one of the tertiary power line PL"1~PL"m.

Figure 4:
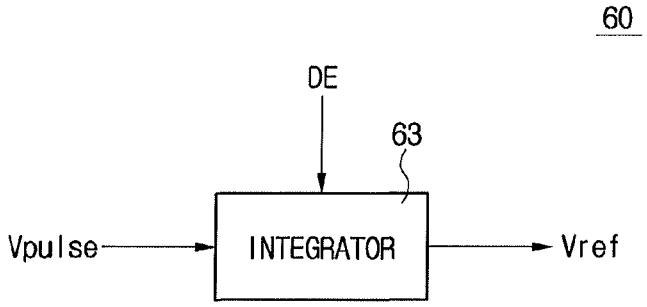
FIG. 4 is a block diagram showing a first example for a part of the power supplier FIG. 2.
Figure 5:
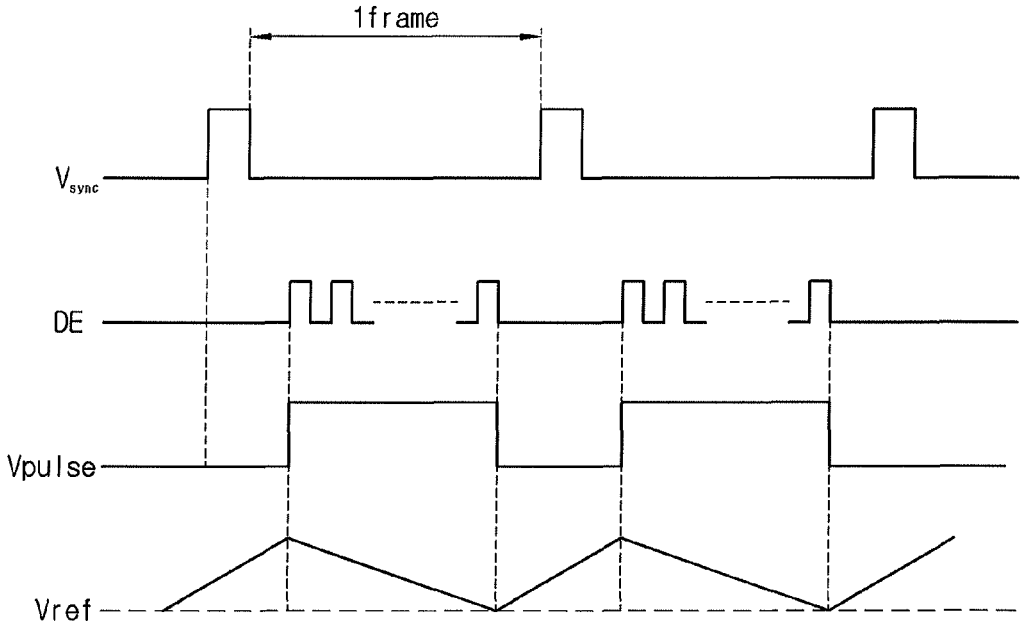
FIG. 5 is a waveform diagram illustrating a reference voltage according to a first embodiment of the present disclosure.

FIG. 4 is a block diagram showing a first example for a part of the power supplier FIG. 2. FIG. 5 is a waveform diagram illustrating a reference voltage according to a first embodiment of the present disclosure.

As shown in FIG. 4, the power supplier 60 can include an integrator 63.

The integrator 63 can generate the reference voltage Vref using a pulse voltage Vpulse and the data enable signal DE which are applied from the controller 30 in FIG. 2. In other words, the integrator 63 can receive the pulse voltage Vpulse and output the reference voltage Vref in synchronization with the data enable signal DE.

Referring to the waveform diagram of FIG. 5, the data enable signal DE has alternately high and low levels after a falling edge of the vertical synchronous signal Vsync which defines a single frame.

The pulse voltage Vpulse can rise to the high level in synchronization with the rising edge of the first data enable signal DE and fall to the low level in synchronization with the falling edge of the last data enable signal DE, within every frame.

The integrator 63 integrates the pulse voltage Vpulse during a supply interval of the data enable signal DE. As such, the reference voltage Vref can linearly decrease during the supply interval of the data enable signal DE. Also, the reference voltage Vref can gradually increase in the low level interval of the pulse voltage Vpulse.

In this manner, the organic light emitting display device of the present disclosure enables the reference voltage Vref to be varied along the time lapse within a single frame including the supply interval of the data enable signal DE. In accordance therewith, the voltage decrement caused by the resistance of the power line can be compensated by the periodically varied reference voltage Vref. Therefore, non-uniformity of brightness can be prevented, and furthermore picture quality can be enhanced.

Figure 6:
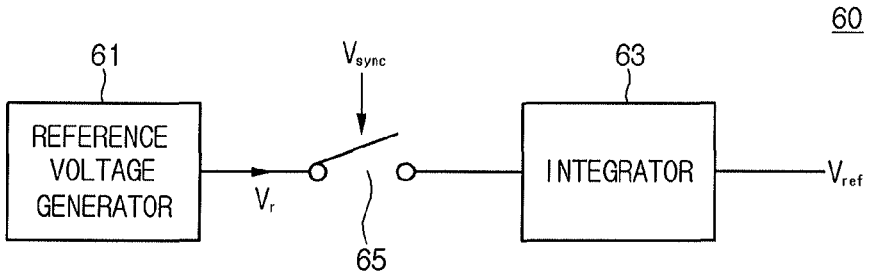
FIG. 6 is a block diagram showing a second example for a part of the power supplier FIG. 2.

FIG. 6 is a block diagram showing a second example for a part of the power supplier FIG. 2.

Referring to FIG. 6, the power supplier 60 of a second example includes a reference voltage generator 61 and an integrator 63. Also, the power supplier 60 includes a switch 65 connected between the reference voltage generator 61 and the integrator 63.

The reference voltage generator 61 can divide an external voltage and output a divided voltage as a basic voltage Vr. The basic voltage Vr can be a direct-current (DC) voltage. The basic voltage Vr can be set to the highest level of the reference voltage which is applied to the organic light emitting display panel 10.

The basic voltage Vr can be selectively transferred to the integrator 63 by turning-on the switch 65. The switch 65 can be turned-on/off by the vertical synchronous signal Vref. Such a switch 65 can be a transistor.

The integrator 63 can integrate the basic voltage Vr, which is applied through the switch 65, and generate the reference voltage Vref. The reference voltage Vref is applied from the integrator 63 to the organic light emitting display panel 10.

Figure 7:
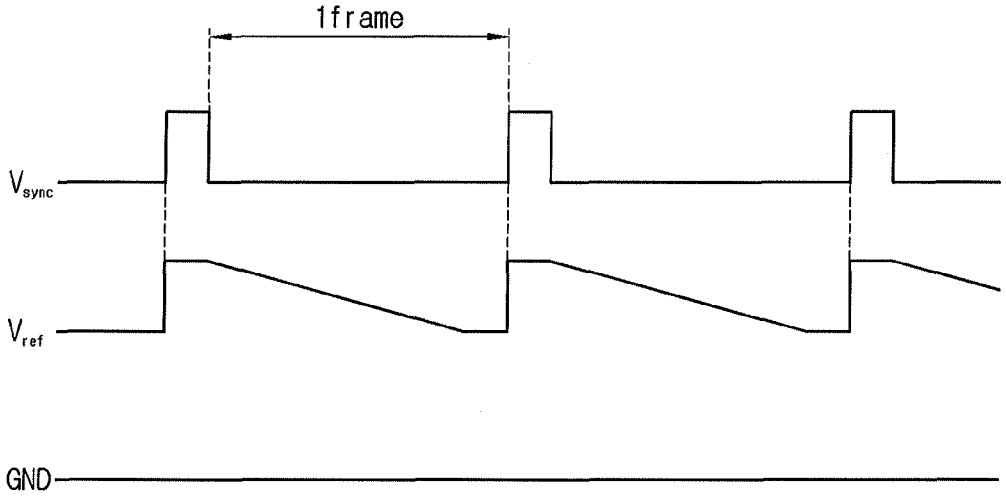
FIG. 7 is a waveform diagram illustrating a reference voltage according to a second embodiment of the present disclosure.

FIG. 7 is a waveform diagram illustrating a reference voltage according to a second embodiment of the present disclosure.

As shown in FIG. 7, the vertical synchronous signal Vsync defines a single frame. The basic voltage Vr is transferred from the reference voltage generator 61 to the integrator 63 in synchronization with the rising of the vertical synchronous signal Vref. The integrator 63 integrates the basic voltage Vr in synchronization with the falling edge of the vertical synchronous signal Vsync and outputs an integrated voltage as the reference voltage Vref.

The switch 65 is turned-on when the vertical synchronous signal Vsync maintains the high level. On the contrary, the switch 65 is turned-off when the vertical synchronous signal Vsync has the low level.

If the switch 65 is turned-on by the vertical synchronous signal Vsync with the high level, the basic voltage Vr is charged into the integrator 63. Also, the basic voltage Vr is not applied to the integrator 63 when the switch 65 is turned-off by the vertical synchronous signal Vsync with the low level. The integrator 63 integrates the charged voltage and generates the reference voltage Vref. The reference voltage Vref is applied from the integrator 63 to the organic light emitting display panel 10.

In this manner, the organic light emitting display device of the present disclosure enables the reference voltage Vref to be varied along the time lapse within a single frame. In accordance therewith, the voltage decrement caused by the resistance of the power line can be compensated by the periodically varied reference voltage Vref. Therefore, non-uniformity of brightness can be prevented, and furthermore picture quality can be enhanced.

In other words, the reference voltage with a relative high level can be applied to a pixel region remote from the power supplier 60, and the reference voltage with a relative low level can be applied to another pixel region adjacent to the power supplier 60. Therefore, non-uniformity of brightness can be prevented.

FIGS. 8A through 8D are circuit diagrams showing first through fourth examples for the integrator in FIG. 6.

The integrator 63 in FIG. 6 can be configured as any one among configuration examples of FIGS. 8A through 8D.

Figure 8A:
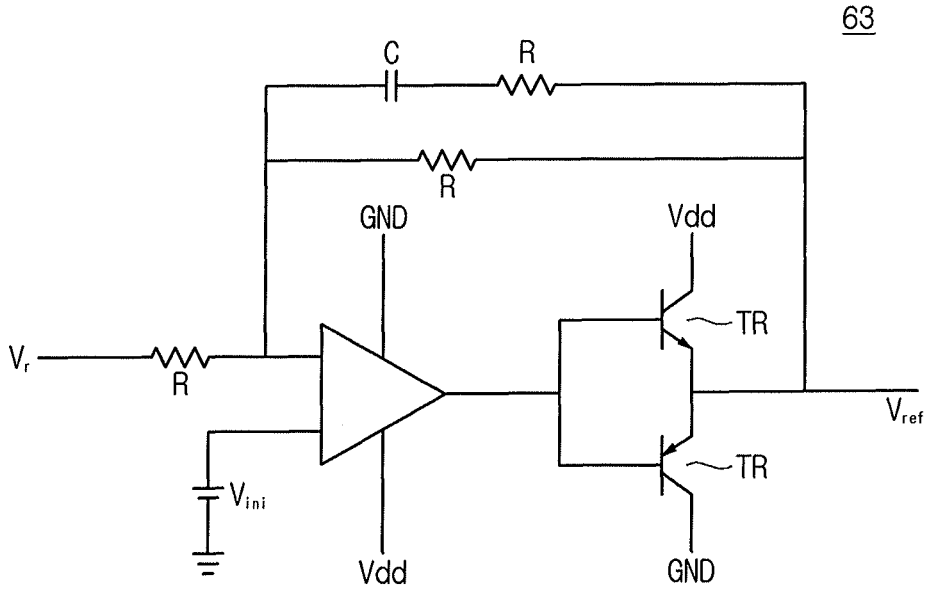
FIGS. 8A through 8D are circuit diagrams showing first through fourth examples for the integrator in FIG. 6.

Referring to FIG. 8A, the integrator 63 of a first example includes an operational amplifier and an initial voltage source connected to an inverting terminal of the operational amplifier. The basic voltage Vr is applied to a non-inverting terminal of the operational amplifier. An output terminal of the operational amplifier is connected to gate electrodes of two transistors which are serially connected to each other. The basic voltage Vr is integrated by a serial circuit of a capacitor and a resistor and another resistor, which is connected to the serial circuit, thereby generating the reference voltage Vref.

Figure 8B:
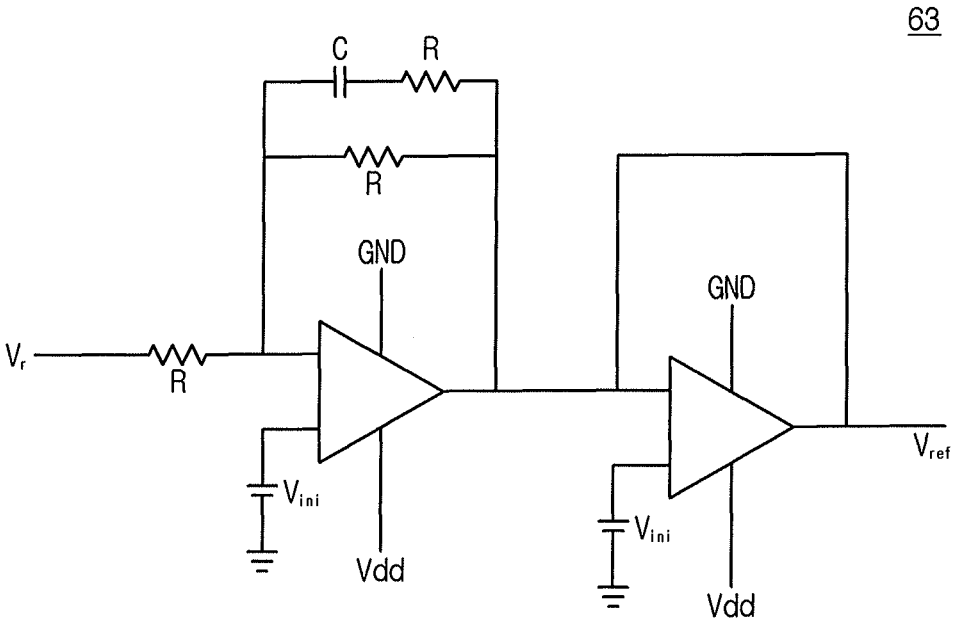

As shown in FIG. 8B, the integrator 63 of a second example includes another operational amplifier which is added to the configuration of FIG. 8A. An inverting terminal and an output terminal of the added operational amplifier are connected to each other. As such, the added operational amplifier serves a buffer. Such an integrator of FIG. 8B integrates the basic voltage Vr and outputs an integrated voltage as the reference voltage Vref.

Figure 8C:
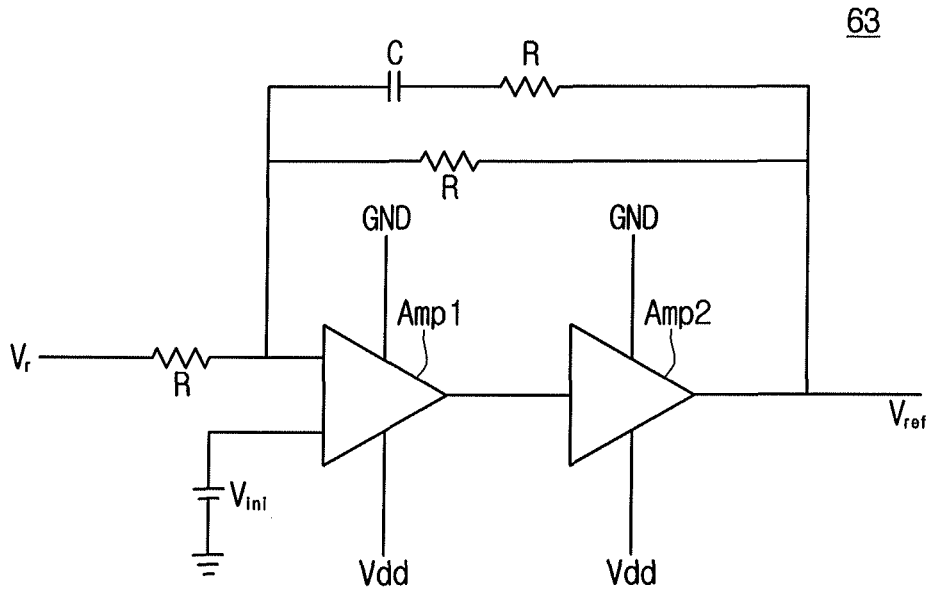

Referring to FIG. 8C, the integrator 63 of a third example includes another operational amplifier instead of the two transistors in FIG. 8A. The integrator 63 of the second example integrates the basic voltage Vr and outputs an integrated voltage as the reference voltage Vref.

Figure 8D:
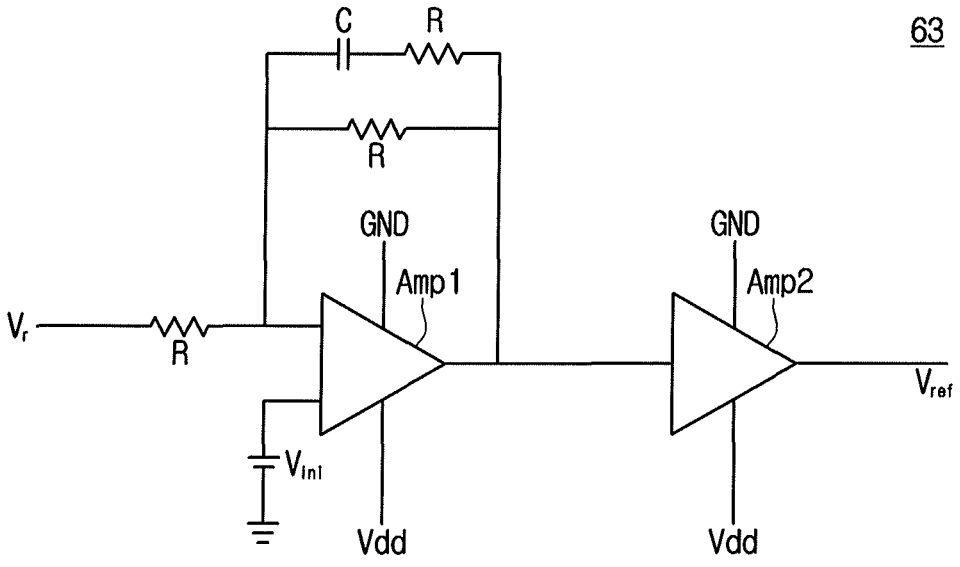

As shown in FIG. 8D, the integrator 63 of a fourth example has a configuration that the inverting terminal and the output terminal of the added operational amplifier in FIG. 8B are disconnected to each other. As such, the added operational amplifier can serve as amplifier and buffer. Therefore, the integrator 63 of the fourth example integrates the basic voltage Vr and outputs an integrated voltage as the reference voltage Vref.

Although the examples for the integrator 63 in FIG. 6 have been described referring to FIGS. 8A through 8D, the configuration examples of FIGS. 8A through 8D can be applied to the integrator 63 of FIG. 4. In this case, the pulse voltage Vpulse instead of the basic voltage Vr can be applied to input stages in FIGS. 8A through 8D.

Figure 9:
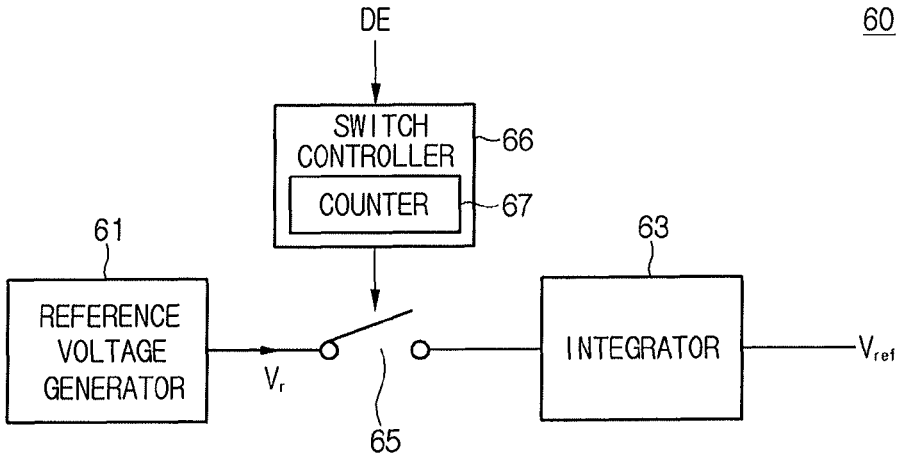
FIG. 9 is a block diagram showing a third example for a part of the power supplier FIG. 2.
Figure 10:
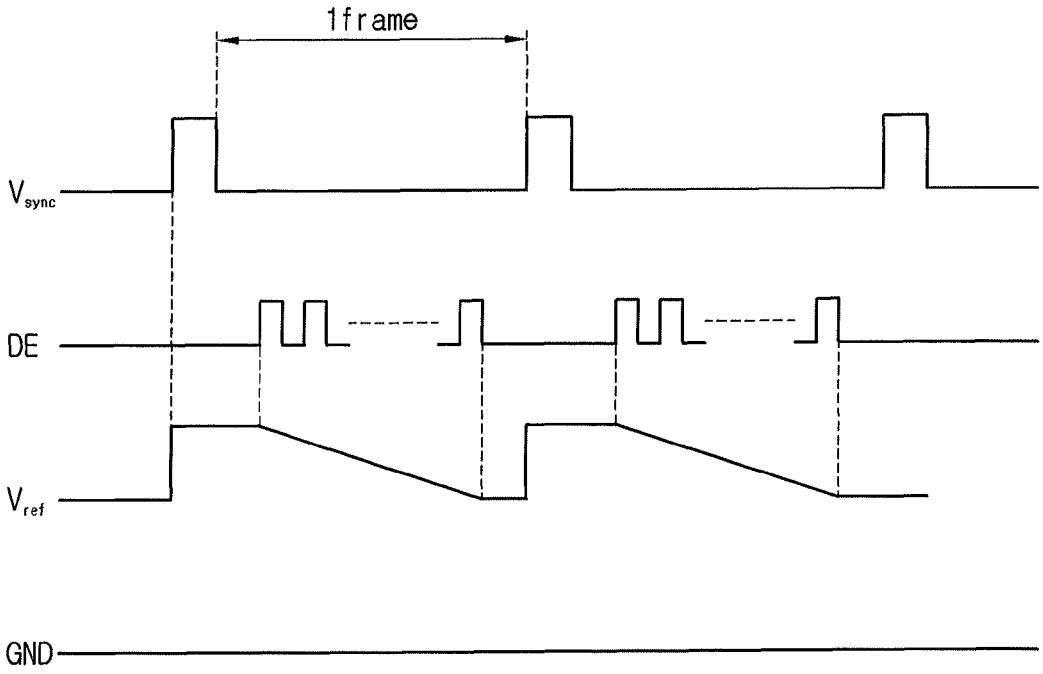
FIG. 10 is a waveform diagram illustrating a reference voltage according to a third embodiment of the present disclosure.

FIG. 9 is a block diagram showing a third example for a part of the power supplier FIG. 2. FIG. 10 is a waveform diagram illustrating a reference voltage according to a third embodiment of the present disclosure.

A part of the power supplier according to a third example has the same configuration as that of the second example, except that the basic voltage Vr is selectively transferred by a switch controller which replies to the data enable signal DE instead of the vertical synchronous signal Vsync. As such, the description of the third example overlapping with the second example will be omitted.

Referring to FIGS. 9 and 10, the power supplier 60 of a third example includes a reference voltage generator 61 and an integrator 63. Also, the power supplier 60 further includes a switch 65 positioned between the reference voltage generator 61 and the integrator 63.

The data enable signal DE is transferred from the controller 30 to a switch controller 66. The switch controller 66 can include a counter 67. The switch controller 66 controls the turning-on/off of the switch 65 using the data enable signal DE.

The data enable signal DE has alternately high and low levels after a falling edge of the vertical synchronous signal Vsync which defines a single frame. The switch 65 can be turned-on in synchronization with the rising edge of the vertical synchronous signal Vsync. Also, the switch 65 can be turned-off in synchronization with a first rising edge of the data enable signal DE.

After the switch 65 is turned-off in synchronization with the first rising edge of the data enable signal DE, the integrator 63 integrates the basic voltage Vr and generates the reference voltage Vref. The first rising edge of the data enable signal DE corresponds to a time point when the data voltage Vdata is applied a first pixel region. Also, the integrator 63 performs the integration of the basic voltage Vr in synchronization with the first rising edge of the data enable signal DE. As such, the integrator 63 can generate the reference voltage Vref from an accurate time point.

The counter 67 can count the number of pulses (i.e., falling edges) of the data enable signal DE. When the counted value reaches a previously set value, the counter 67 can control the integrator 63 to terminate the integral operation. In other words, the counter 67 can count the pulses (i.e., the falling edges) corresponding to a defined row number of the pixel regions and terminate the operation of the integrator 63. Therefore, the integrator 63 can perform the integral operation during only a desired time period.

Figure 11:
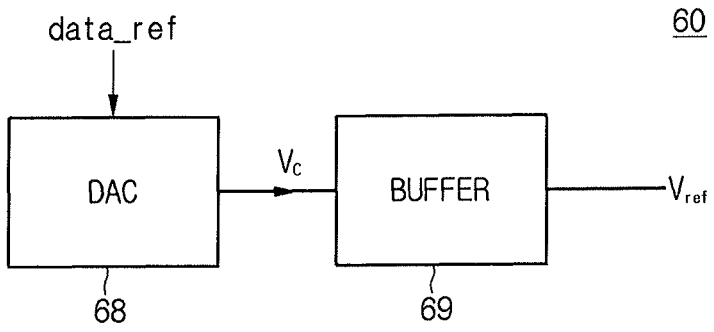
FIG. 11 is a block diagram showing a fourth example for a part of the power supplier FIG. 2.

FIG. 11 is a block diagram showing a fourth example for a part of the power supplier FIG. 2.

A part of the power supplier according to a fourth example has the same configuration as that of the first example, with the exception of including a DAC (digital-to-analog converter) 68 and a buffer 69. As such, the description of the fourth example overlapping with the first example will be omitted.

Referring to FIG. 11, the power supplier 60 of a fourth example includes a DAC 68 and a buffer 69.

The DAC 68 can receive a reference data 'data_ref' from the controller 30. The reference data data_ref is a digital signal corresponding to a desired reference voltage Vref.

The DAC 68 can convert the reference data data_ref into an analog voltage and output the converted analog voltage as the reference voltage Vref to the organic light emitting display panel 10 through the buffer 69. Alternatively, the DAC 68 converting the reference data data_ref into the analog voltage can directly apply the converted analog voltage to the organic light emitting display panel 10 as the reference voltage Vref.

In another manner, the DAC 68 can convert the reference data data_ref into a middle voltage Vc corresponding to an analog voltage and apply the middle voltage Vc to the buffer 69. In this case, the buffer 69 can amplify the middle voltage Vc up to the reference voltage Vref and apply the amplified reference voltage Vref to the organic light emitting display panel.

Such a power supplier 60 according to the fourth example can generate the reference voltage which gradually decreases in synchronization with the data enable signal DE as shown in FIG. 10. Also, the power supplier 60 can apply the reference voltage to the organic light emitting display panel 10.

Figure 12A:
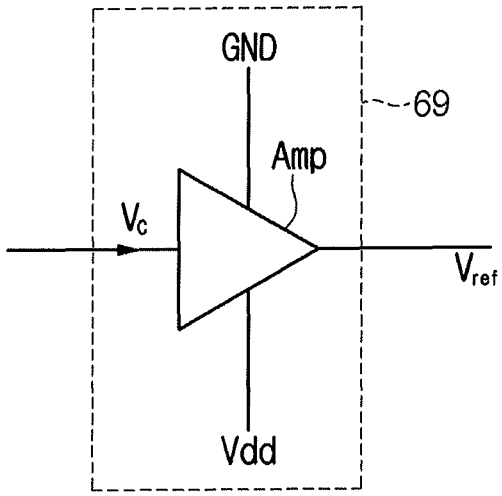
FIGS. 12A and 12B are circuit diagrams showing first and second examples for the buffer in FIG. 11.
Figure 12B:
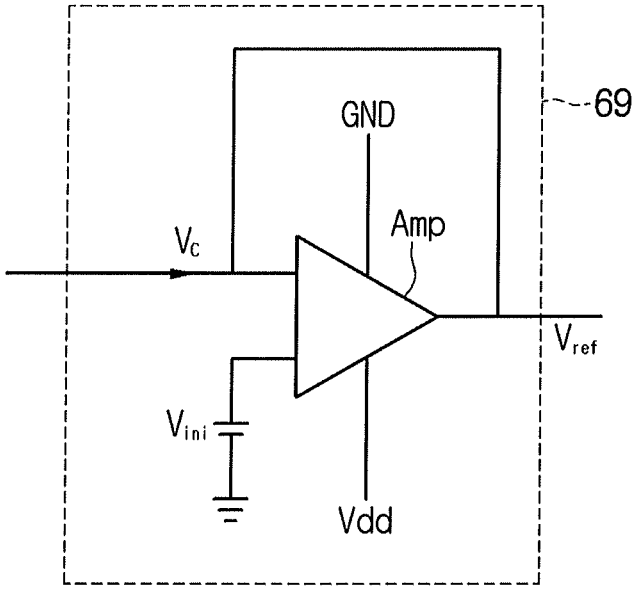

The buffer 69 can be configured as shown in FIGS. 12A and 12B. As shown in FIG. 12A, the buffer 69 can include a single operational amplifier. The operational amplifier can receive the middle voltage Vc and amplify the middle voltage Vc up to the reference voltage Vref. The reference voltage Vref can be applied from the operational amplifier to the organic light emitting display panel 10.

Alternatively, the buffer 69 can include a single operational amplifier having an inverting terminal and an output terminal which are connected to each other, as shown in FIG. 12B. The operational amplifier can buffer the middle voltage Vc applied from the DAC 68 and output the buffered middle voltage Vc as the reference voltage Vref.

As described above, the organic light emitting display device allows the reference voltage applied to the pixel regions, which are adjacent to and remote from the power supplier, to be gradually varied. As such, non-uniformity of brightness due to the resistance of the power line can be prevented. Therefore, picture quality can be enhanced.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting display device comprising:

an organic light emitting display panel that includes a first power line, a second power line, a third power line, a plurality of scan lines and a plurality of data lines;

a first transistor connected among a first node to which a data voltage of the data line is supplied, a second node which a reference voltage of the second power line is supplied and the first power line;

an organic light emitting diode connected between the second node and the third power line;

a power supplier configured to apply the reference voltage to the second power line; and a controller configured to apply at least one control signal including a data enable signal to the power supplier, wherein the data enable signal includes a plurality of high levels and a plurality of low levels alternately arranged in each frame, a rising edge of a first high level and a falling edge of a last high level in each frame define a supply interval of the data enable signal, wherein the reference voltage is synchronized with the supply interval of the data enable signal and gradually decreases during the supply interval of the data enable signal, wherein the first transistor controls a current being applied to the organic light emitting diode according to a difference voltage between the data voltage and the reference voltage.

2. The organic light emitting display device of claim 1, wherein the power supplier includes:

a reference voltage generator configured to generate a basic voltage corresponding to a direct-current voltage;

an integrator configured to integrate the basic voltage and generate the reference voltage; and a switch configured to selectively transfer the basic voltage to the integrator.

3. The organic light emitting display device of claim 2, wherein the switch is controlled by a vertical synchronous signal applied from the controller.

4. The organic light emitting display device of claim 3, wherein the switch is turned-off in a low level interval of the vertical synchronous signal.

5. The organic light emitting display device of claim 3, wherein the reference voltage gradually decreases when the vertical synchronous signal is low level.

6. The organic light emitting display device of claim 2, further comprising a switch controller controls the switch.

7. The organic light emitting display device of claim 6, wherein the switch controller is controlled by the data enable signal applied from the controller.

8. The organic light emitting display device of claim 7, wherein the switch controller includes a counter configured to count the number of pulses of the data enable signal.

9. The organic light emitting display device of claim 7, wherein the switch is turned-off at a first rising edge of the data enable signal.

10. The organic light emitting display device of claim 1, wherein the power supplier includes a DAC (digital-to-analog converter) configured to convert a reference data from the controller into a basic voltage, the reference data is a digital signal, and the basic voltage is an analog voltage.

11. The organic light emitting display device of claim 10, wherein the power supplier further includes a buffer configured to amplify the basic voltage from the DAC and provide the amplified voltage as the reference voltage.

12. The organic light emitting display device of claim 1, wherein the power supplier includes an integrator configured to integrate a pulse voltage from the controller according to time and generate the reference voltage.

13. The organic light emitting display device of claim 12, wherein the pulse voltage is output from the controller in synchronization with the data enable signal.

14. The organic light emitting display device of claim 13, wherein the pulse voltage maintains a high level during a time interval which progresses from a first rising edge to the last falling edge of the data enable signal.

15. The organic light emitting display device of claim 1, an organic light emitting display panel that further includes:

a second transistor controlled with a gate signal of the gate line and connected between the data line and the first node; and a third transistor controlled with the gate signal of the gate line and connected between the second power line and the second node.

* * * * *